US006036520A

United States Patent [19]

Tojo

[11] Patent Number: 6,036,520

[45] Date of Patent: Mar. 14, 2000

[54] ELECTRICAL CONNECTOR FOR FLAT CIRCUITRY

[75] Inventor: Katsutoshi Tojo, Sagamihara, Japan

[73] Assignee: Molex Incorporated, Lisle, Ill.

[21] Appl. No.: 09/121,435

[22] Filed: Jul. 23, 1998

[30] Foreign Application Priority Data

Dec. 12, 1997 [JP] Japan ..... 9-362849
Dec. 12, 1997 [JP] Japan ..... 9-362850

[51] Int. Cl.[7] ..... H01R 13/15

[52] U.S. Cl. ..... 439/260; 439/325; 439/329

[58] Field of Search ..... 439/260, 495, 439/67, 259, 77, 569, 570, 571, 590, 325, 327

[56] References Cited

U.S. PATENT DOCUMENTS

| | | | |
|---|---|---|---|
| 4,023,877 | 5/1977 | Hennessey et al. | 439/329 |
| 4,235,500 | 11/1980 | Belopavlovich et al. | 439/495 |
| 4,416,497 | 11/1983 | Brandsness et al. | 439/329 |
| 4,477,137 | 10/1984 | Ayer | 439/590 |
| 4,509,811 | 4/1985 | Amano et al. | 439/329 |
| 4,639,063 | 1/1987 | Mueller | 439/325 |
| 4,824,391 | 4/1989 | Ii | 439/329 |
| 5,199,884 | 4/1993 | Kaufman et al. | 439/74 |
| 5,695,359 | 12/1997 | Fujikura | 439/495 |

*Primary Examiner*—Paula Bradley
*Assistant Examiner*—Alexander Gilman
*Attorney, Agent, or Firm*—Stephen Z. Weiss

[57] ABSTRACT

An electrical connector is provided for mounting on a surface of a printed circuit board and for receiving a flat electrical circuit. The connector includes an elongated dielectric housing defining a slot for receiving the flat electrical circuit. A plurality of terminals are mounted on the housing, with contact portions spaced along the slot. A metal fixing member is mounted on the housing for securing the connector to an appropriate mounting pad on the printed circuit board. A metal actuator is mounted on the housing for movement between a first position allowing free insertion of the flat electrical circuit into the slot and a second position biasing the flat electrical circuit against the contact portions of the terminals. Complementary interengaging latches are provided between the metal fixing member and the metal actuator to define one or more of the positions of the actuator.

6 Claims, 11 Drawing Sheets

ELECTRICAL CONNECTOR FOR FLAT CIRCUITRY

FIELD OF THE INVENTION

This invention generally relates to the art of electrical connectors and, particularly, to connectors for electrically interconnecting flat electrical circuitry such as flat flexible circuitry.

BACKGROUND OF THE INVENTION

A flat flexible electrical circuit conventionally includes an elongated flat flexible dielectric substrate having laterally spaced strips of conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board or the terminals of a mating connector.

A wide variety of zero insertion force electrical connectors have been designed particularly adapted for terminating flat circuits, such as flat flexible circuits, flexible printed circuit boards and the like. These electrical connectors conventionally have a housing mounting a plurality of terminals in a generally parallel array spaced along an elongated opening or slot for receiving an end of the flat circuit. Typically, these connectors use actuators to push the flat circuits, flexible printed circuit boards or the like against resilient contact portions of the terminals.

The actuators of these flat circuit connectors typically are movable between a first position allowing free insertion of the flat circuit into the elongated opening or slot in the housing, and a second position wherein a pressure plate portion of the actuator biases the circuit against the contact portions of the terminals. For instance, the pressure plate biases the exposed conductors of a flat circuit against the contact portions of the terminals.

Major problems continue to plague such connectors, particularly in the areas of cost, size, operability and reliability. With the ever-increasing miniaturization of electronic circuitry, it has become desirable to provide connectors for flat circuits as thin as possible. It is desirable to provide some form of temporary holding means on the connectors for preliminarily holding the flat circuit. It also is desirable to provide some sort of means to hold the actuator in one or both of its positions on the connector housing. Providing these features or means are difficult with extremely small or miniaturized connectors. The present invention is directed to solving one or more of these problems and satisfying such needs.

SUMMARY OF THE INVENTION

An object, therefore, of the invention is to provide a new and improved electrical connector for receiving a flat electrical circuit.

Another object of the invention is to provide such a connector for mounting on a surface of a printed circuit board.

In the exemplary embodiment of the invention, the connector includes an elongated dielectric housing defining a slot for receiving the flat electrical circuit. A plurality of terminals are mounted on the housing, with contact portions spaced along the slot. A metal fixing member is mounted on the housing for securing the connector to an appropriate mounting pad on the printed circuit board. A metal actuator is mounted on the housing for movement between a first position allowing free insertion of the flat electrical circuit into the slot and a second position biasing the flat electrical circuit against the contact portions of the terminals. Complementary interengaging positioning means are provided between the metal fixing member and the metal actuator to at least partially define at least one of said positions of the actuator.

As disclosed herein, a plurality of the fixing members are mounted on the housing. With the housing being elongated, preferably one of the fixing members and the complementary interengaging positioning means are provided at each opposite end of the elongated housing.

According to one aspect of the invention, the complementary interengaging positioning means include a latch tab on the metal actuator which snaps into engagement with a complementary latch tab on the metal fixing member. This engagement is effected automatically in response to movement of the actuator to its second position.

According to another aspect of the invention, the complementary interengaging positioning means include a flexible latch arm on the metal actuator which seats behind a pair of stop shoulders on the metal fixing member to define the two positions of the actuator. In the exemplary embodiment, the flexible latch arm and stop shoulders are located on a bottom side of the connector. The aforementioned latch tabs on the actuator and on the fixing member are located on a top side of the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
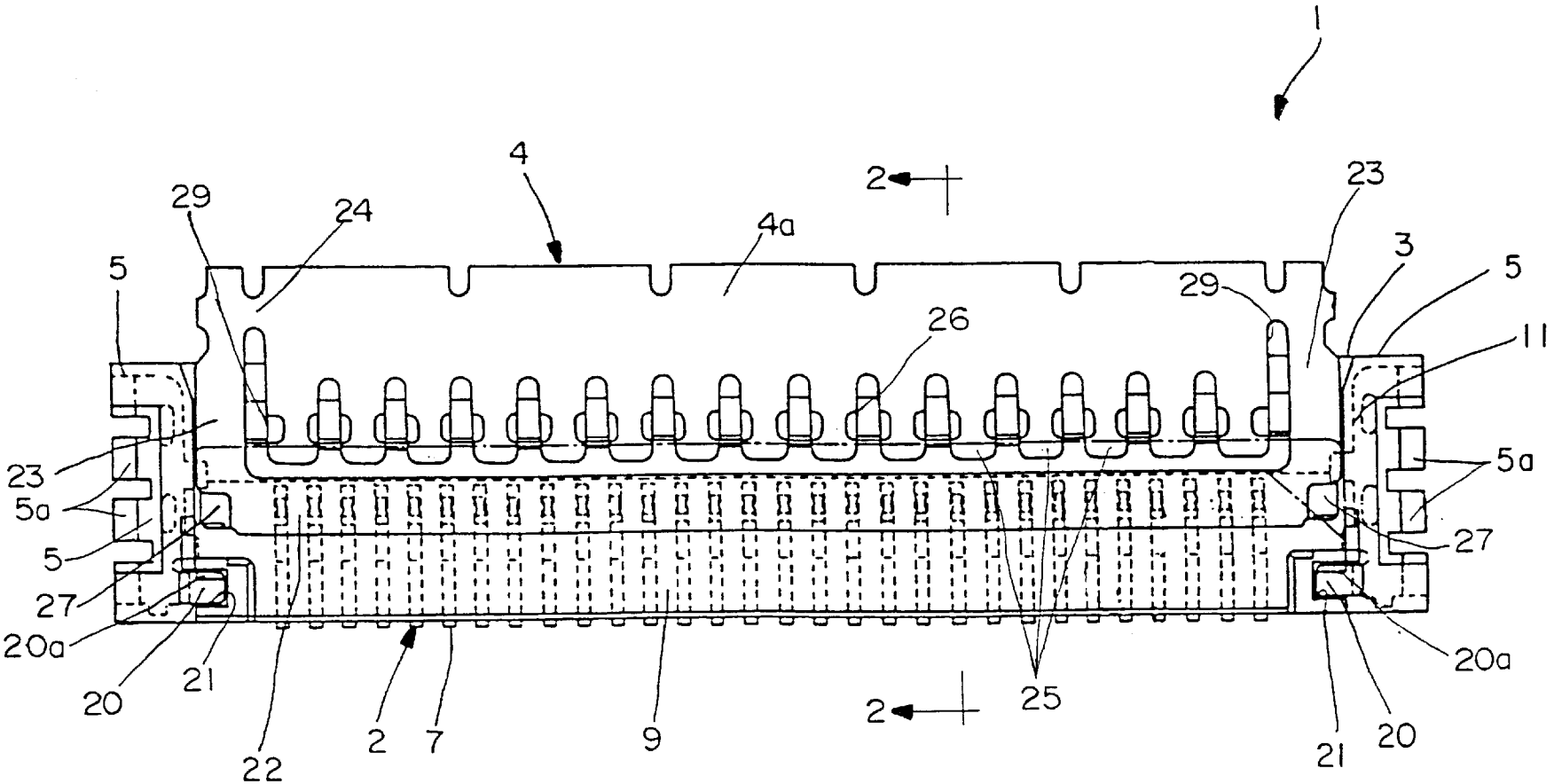
FIG. 1 is a top plan view of a flat circuit connector according to a first embodiment.

Referring to the drawings in greater detail, FIGS. 1–7 show a first embodiment of an electrical connector, generally designated 1, for receiving or terminating a flat electrical circuit, such as a flat flexible circuit, a printed circuit board or the like. FIGS. 8–20 show a second embodiment of an electrical connector, generally designated 41, also for receiving or terminating a flat electrical circuit.

Turning first to FIGS. 1–7, connector 1 includes an elongated dielectric housing 3 mounting a plurality of terminals 2 mounted on the housing in a parallel arrangement at regularly spaced intervals longitudinally of the housing. A generally U-shaped actuator, generally designated 4, is mounted on the housing for movement between a first position allowing free insertion of a flat electrical circuit into the connector and a second position biasing the circuit against the terminals, as will be seen hereinafter. A metal fixing member 5 is insert-molded in housing 3 at each opposite end thereof.

Figure 2:
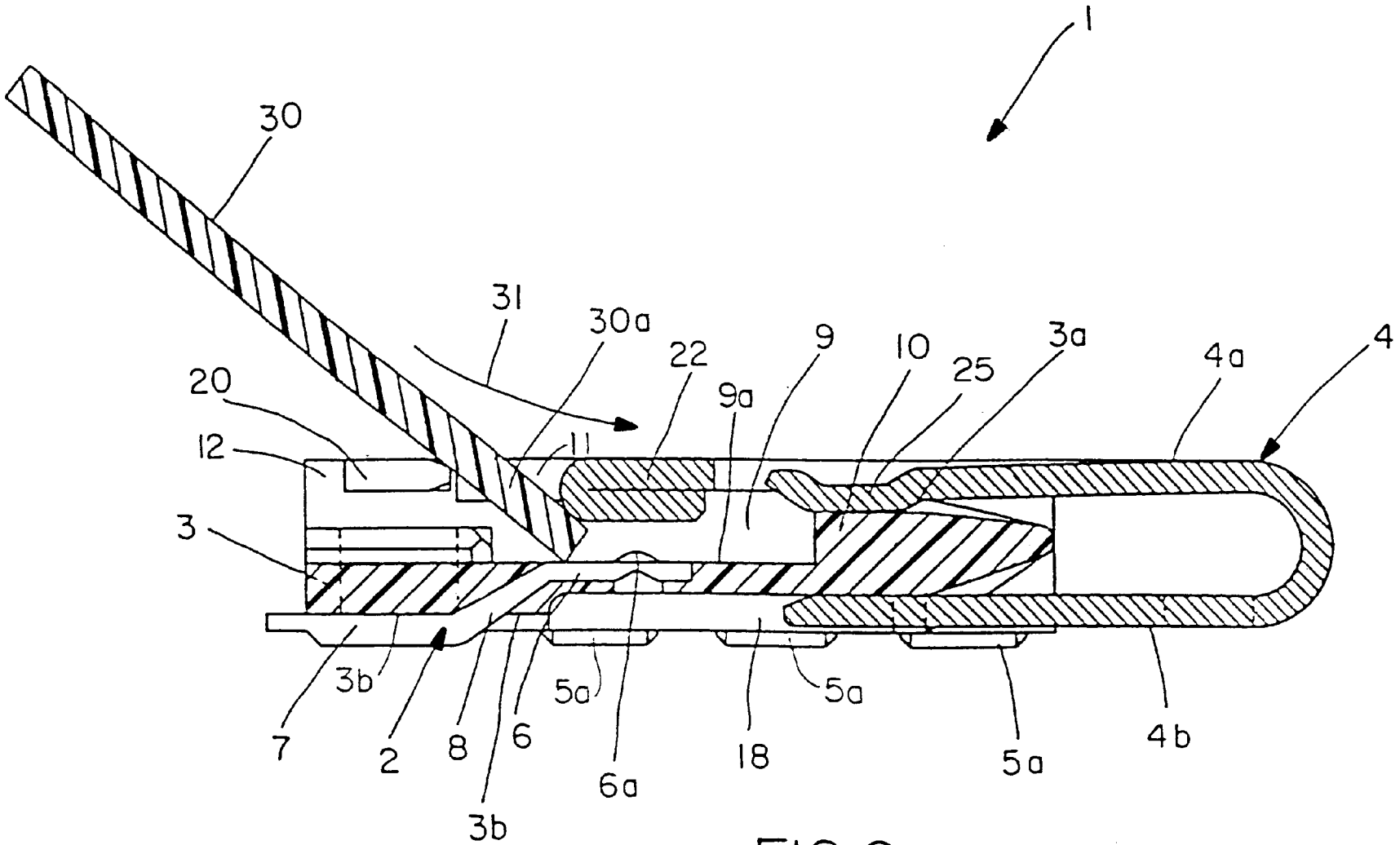
FIG. 2 is an enlarged vertical section taken generally along line 2—2 of FIG. 1.
Figure 3:
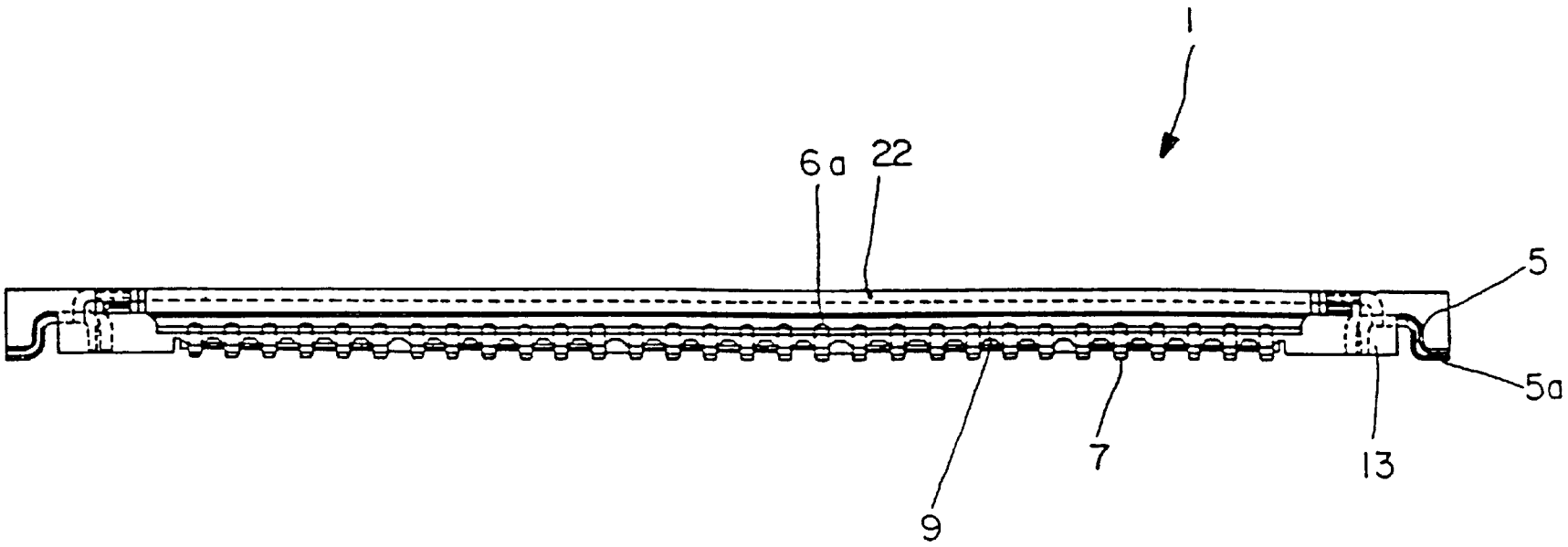
FIG. 3 is a front elevational view of the connector of FIG. 1.
Figure 5:
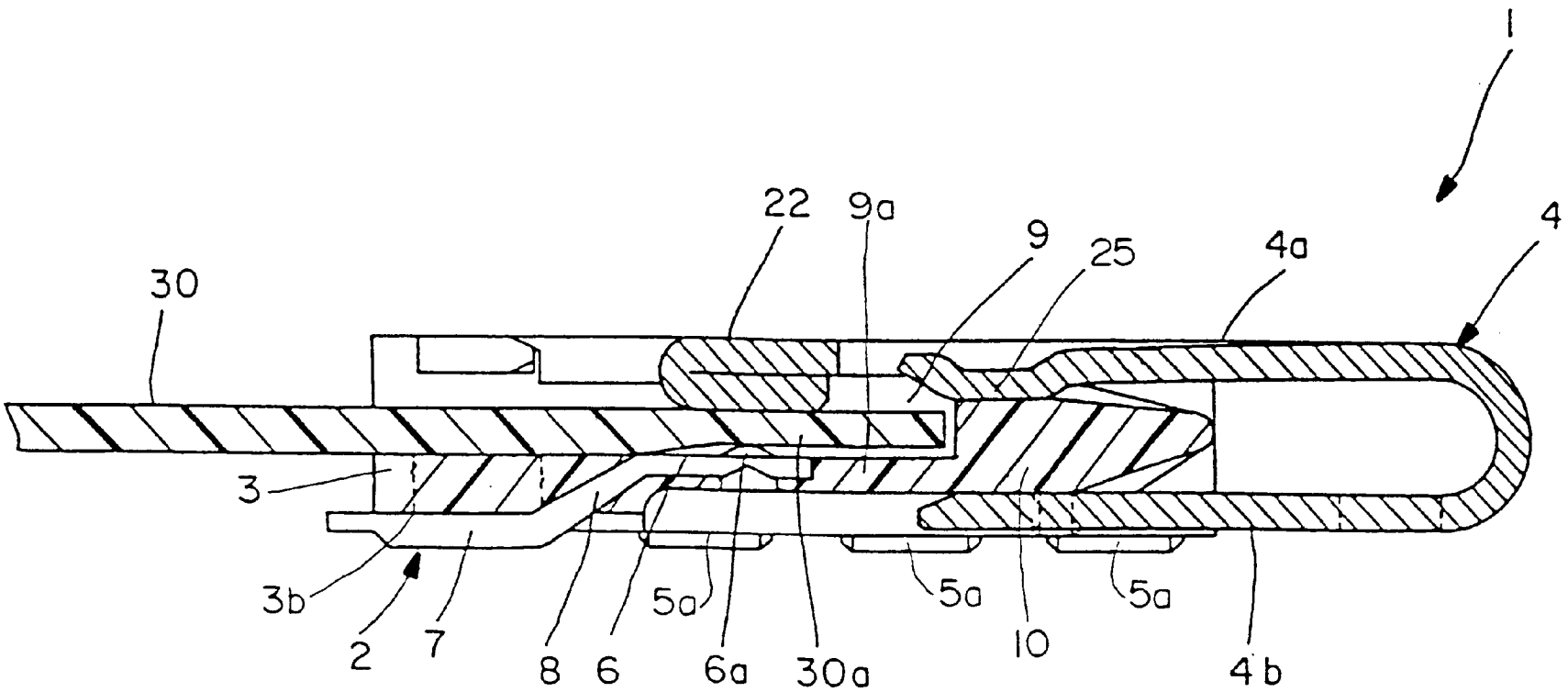
FIG. 5 is a view similar to that of FIG. 2, with the connector temporarily holding the flat circuit.

As best seen in FIGS. 2 and 5, each terminal 2 is stamped and formed from sheet metal material and includes a contact portion 6 having a raised contact projection 6*a* intermediate its opposite ends. The contact portion is joined to a horizontal solder tail 7 by an integral oblique joint section 8. The terminals are insert-molded in housing 3 so that the opposite ends of contact portion 6 are overmolded by the housing. Therefore, at least the opposite ends of the contact portion are rigid or fixed against movement relative to the housing. In most prior art connectors for flat circuits, the contact portions of the terminals are cantilevered and flexible. With the entire contact portion or the opposite ends of the terminals fixed against movement relative to the housing the movement of the contact portion relative to the housing is eliminated or greatly reduced allowing for a thinner housing. By providing an actuator, as described in detail below, having portions located above and below the contact portion, the portion of the housing under the terminal contact portion may be thin and somewhat flexible and still will be able to provide the force needed to make a good electrical engagement between the contact portion and a conductor on the flat circuit 30. Therefore, the connector housings must be enlarged or made thicker to accommodate the flexing movement of the contact portions.

Elongated dielectric housing 3 is a one-piece structure unitarily molded of plastic material or the like. Therefore, the housing can be overmolded about portions of terminals 2 and fixing members 5 by an appropriate insert-molding process. The housing has a generally rectangular plate-like configuration defining a slot 9 at the top/front thereof for receiving a flat circuit 30. The housing has a relatively thick rear section 10 which facilitates mounting actuator 4 thereon. Contact portions 6 of the terminals are generally flush with a floor 9*a* of slot 9, and solder tails 7 of the terminals extend forwardly along a bottom surface 3*b* of the housing and project slightly forwardly of the front of the housing as seen best in FIGS. 2 and 5. Contact portions 6 and oblique joint sections 8 of terminals 2 are embedded in housing 3, with the upper surfaces of contact portions 6 exposed in floor 9*a* of slot 9, and with contact projections 6*a* projecting into the slot.

Figure 4:
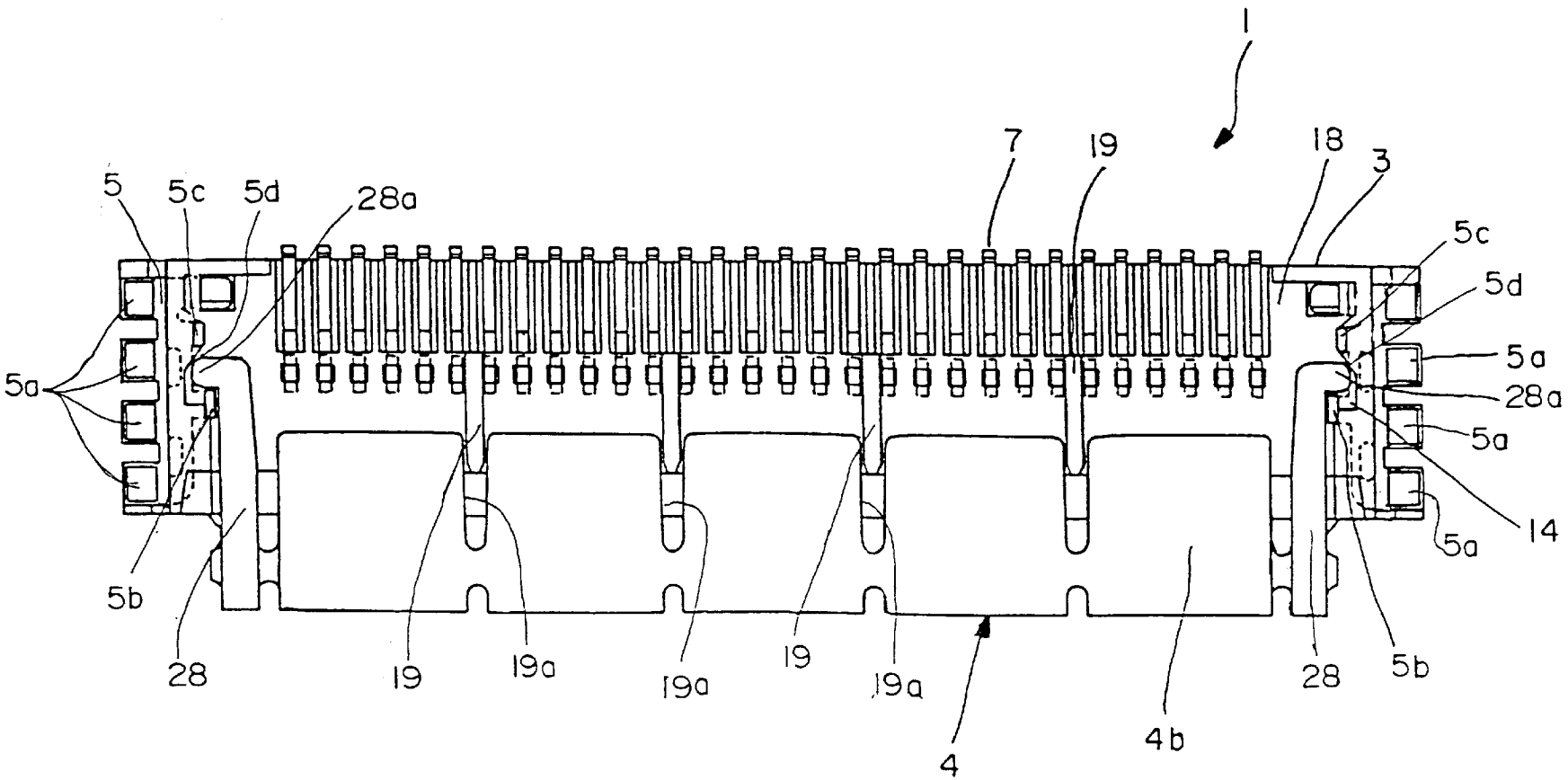
FIG. 4 is a bottom plan view of the connector of FIG. 1.

Dielectric housing 3 also has upper guide walls 11 extending the width of the housing at opposite ends thereof and projecting upwardly from a top surface 3*a* of the housing. Bottom guide walls 13 extend the width of the housing at opposite ends thereof and project downwardly from bottom surface 3*b* of the housing and define a longitudinal recess 18 within which actuator 4 is slidably mounted. As best seen in FIG. 4, the housing has a plurality of guide ribs 19 which project into a corresponding plurality of guide grooves or notches 19*a* in the actuator.

Figure 6:
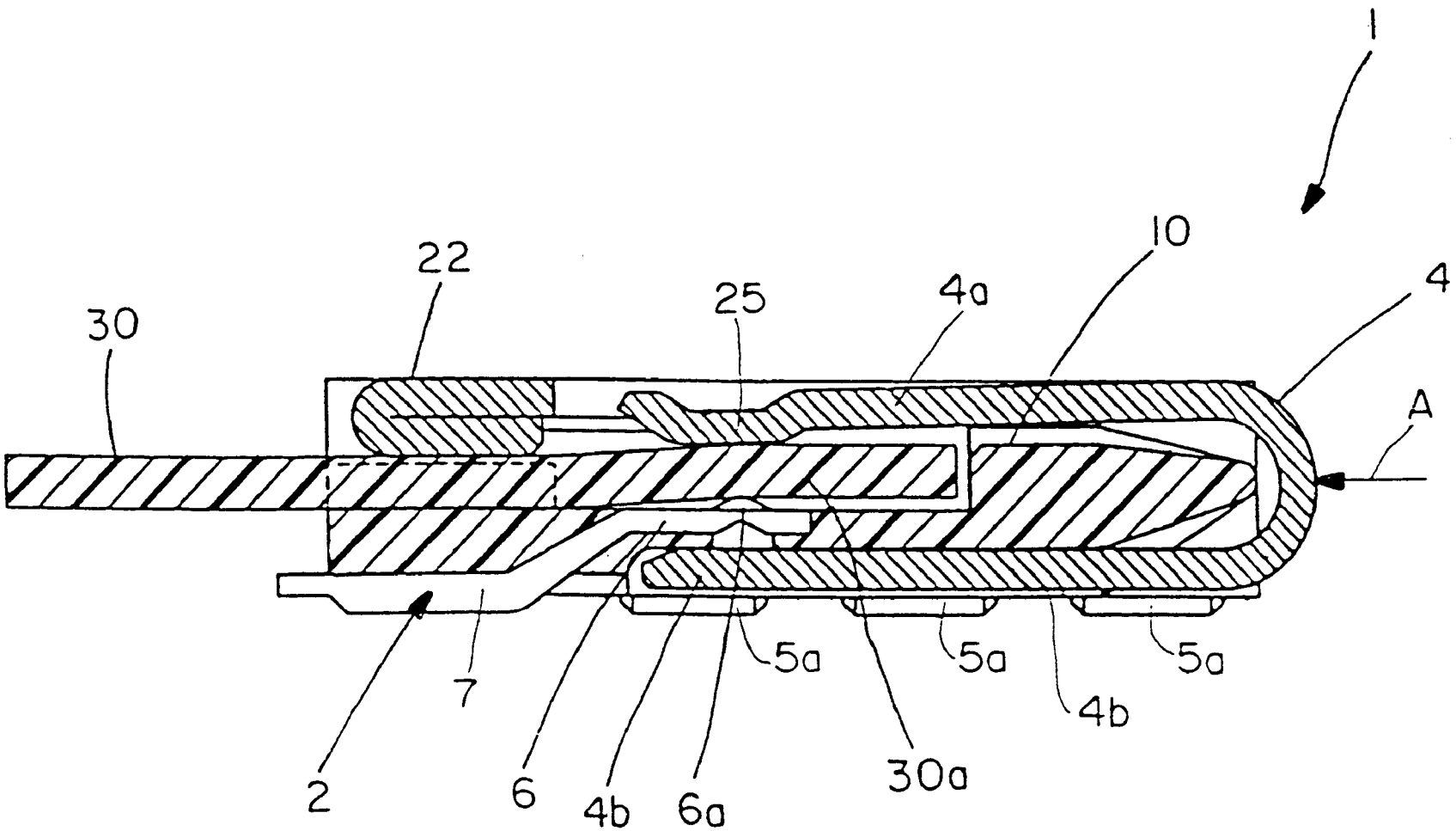
FIG. 6 is a view similar to that of FIG. 5, with the actuator moved to complete the termination of the flat circuit.
Figure 7:
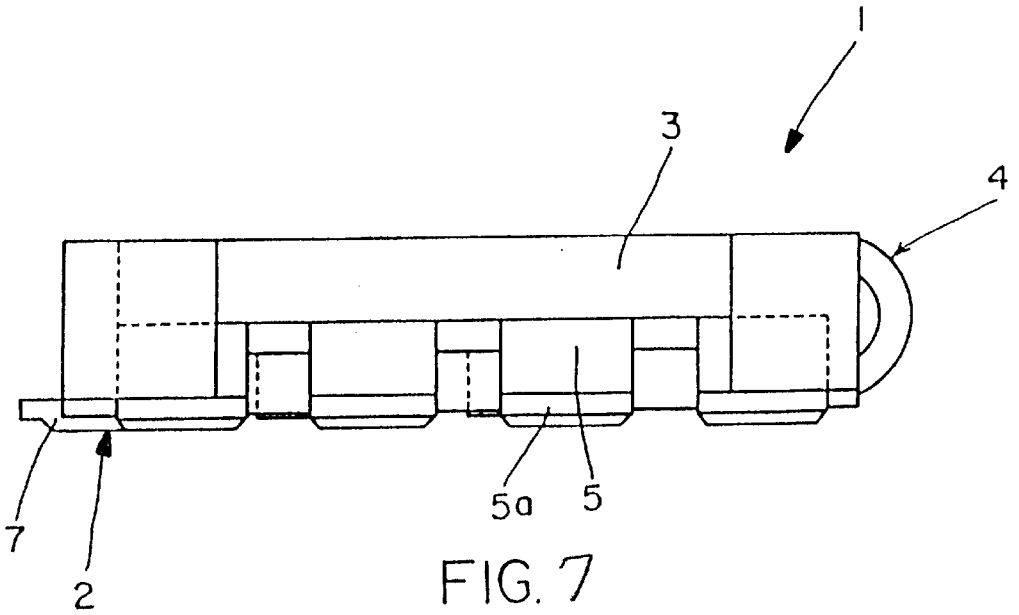
FIG. 7 is an enlarged end elevational view, looking toward the right-hand end of FIG. 1.

Each fixing member 5 is stamped and formed of sheet metal material and includes a plurality of plate portions 5*a*. Portions of the fixing members are overmolded by housing 3, and plate portions 5*a* are exposed for connection, as by soldering, to appropriate mounting pads on a printed circuit board. Therefore, fixing members 5 function to mount the housing and, thereby, the connector to the printed circuit board. The bottom surfaces of plate portions 5*a* are coplanar with the bottom surfaces of solder tails 7 of terminals 2 as seen in FIGS. 2, 5 and 6. The plate portions of the fixing members and the solder tails of the terminals can be soldered simultaneously to the printed circuit board.

As seen in FIG. 1, each fixing member 5 has a latch tab 20 which projects into a recess 21 in the top of housing 3. The latch tabs have upwardly projecting stops 20*a*. As best seen in FIG. 4, each fixing member 5 has first and second stop shoulders 5*b* and 5*c*, respectively, projecting from the bottom of the housing.

Actuator 4 is stamped and formed of sheet metal material, such as stainless steel or the like, into a generally U-shaped configuration to define a top plate 4*a* and a bottom plate 4*b*. A preliminary circuit holding strip 22 is disposed forwardly of top plate 4*a*. Preliminary holding strip 22 forms a cross portion between a pair of legs 23 of a U-shaped section of metal actuator 4. The rear ends of legs 23 are joined, as at 24, to a rear area of top plate 4*a*. In essence, top plate 4*a* forms a pressure plate portion of actuator 4 and includes a plurality of forwardly projecting fingers 25 separated by slots 26. The fingers are used to bias flat circuit 30 against contact projections 6*a* of terminals 7, as will be seen hereinafter. Each finger has a width to cover the contact projections of an adjacent pair of terminals. By separating the fingers by slots 26, any dirt that might accumulate on the contact projections can be swept to the side into the slots during use. Finally in referring to FIG. 1, a latch tab 27 is formed at each front corner of preliminary holding strip 22. The preliminary holding strip is of a double-thickness by folding the metal material of the actuator back onto itself as seen in FIGS. 2, 5 and 6.

Referring to FIG. 4, a flexible latch arm 28 is provided at each end of actuator 4 at the bottom thereof. Each latch arm terminates in an outwardly projecting latch hook 28*a*.

Metal actuator 4 is movable on housing 3 from a first position shown in FIGS. 2 and 5 to a second position shown in FIG. 6. In the first position, flat circuit 30 is free to be inserted into slot 9 of the housing. In the second position, fingers 25 of the actuator bias the circuit against the contact portions of terminals 2. When the actuator is in its first position, latch hooks 28*a* of latch arms 28 seat behind first stop shoulders 5*b* of fixing members 5 as seen in FIG. 4. When the actuator is moved from its first position (FIGS. 2 and 5) to its second position (FIG. 6), latch hooks 28*a* (FIG. 4) are biased inwardly by oblique surfaces 5*d* of fixing members 5 until the latch hooks snap back outwardly into engagement behind second stop shoulders 5*c* of the fixing members. This holds the actuator in its final circuit-terminating position. In addition, referring back to FIG. 1, latch tabs 27 at the top of the actuator and at opposite ends of preliminary holding strip 22 slide under stops 20 of latch tabs 20 of the fixing members 5 when the actuator is moved to its final circuit-terminating position locking the preliminary holding strip against the flat circuit 30 further helping to hold the flat circuit in the connector housing. Therefore, metal-to-metal engagements are provided at both the top and bottom of the connector between the metal actuator and the metal fixing members.

In connecting or terminating flat circuit 30 to connector 1, the circuit is inserted into slot 9 of housing 3 with actuator 4 in its first position as shown in FIG. 2. The circuit is inserted freely and rotated downwardly in the direction of arrow 31 until a front end 30*a* of the circuit is fully inserted into slot 9 as shown in FIG. 5. In this position, and with actuator 4 still in its first or inoperative position, preliminary holding strip 22 temporarily holds the circuit as seen in FIG. 5. The actuator then is pushed forwardly in the direction of arrow "A" (FIG. 6) until pressure fingers 25 of top plate or pressure plate 4*a* of the housing biases the flat circuit against contact projections 6*a* of contact portions 6 of terminals 2. Legs 23 which are connected to preliminary holding strip 22 are separated from pressure fingers 25 and pressure plate 4*a* by open areas or elongated slots 29. Consequently, the flexibility of preliminary holding strip 22 is totally independent or isolated from the flexibility of fingers 25. If desired, the temporary holding forces of preliminary holding strip 22 can be made less than the connecting forces provided by fingers 25. Therefore, the preliminary holding strip can be raised easily by the flat circuit which may be a very small flexible circuit, while fingers 25 apply a stronger connecting force of the circuit against the contact projections of the terminals. When it is desired to remove the circuit from the connector, actuator 4 simply is pulled back rearwardly opposite the direction of arrow "A" (FIG. 6) to its first or inoperative position shown in FIGS. 2 and 5.

Referring to the second embodiment of FIGS. 8–19, connector 41 includes a plurality of terminals 42 for connection to a flat circuit 43, the terminals being insert-molded in a housing 44. Like the first embodiment, the housing is a generally rectangular plate-like structure. A generally U-shaped actuator 45 is mounted on the housing for movement between a first position shown in FIG. 19 allowing free insertion of flat circuit 43 into a slot 46 of the housing and a second position biasing the circuit against contact portions of the terminals.

Figure 9:
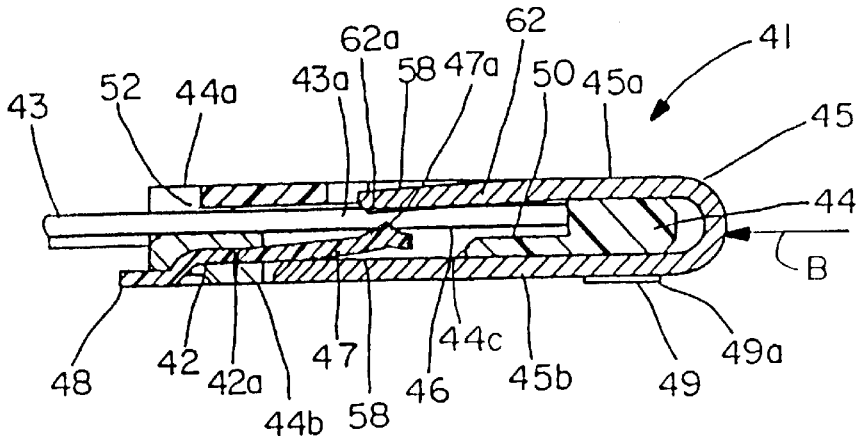
FIG. 9 is an enlarged vertical section taken generally along lines 9—9 of FIG. 8, with the connector terminating a flat circuit.
Figure 10:
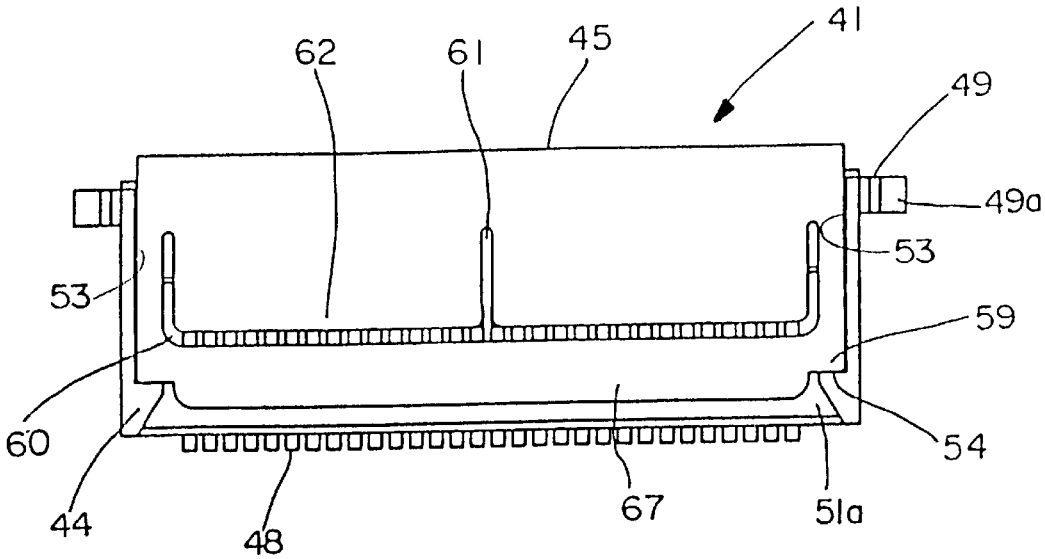
FIG. 10 is a bottom plan view of the connector of FIG. 8.
Figure 11:
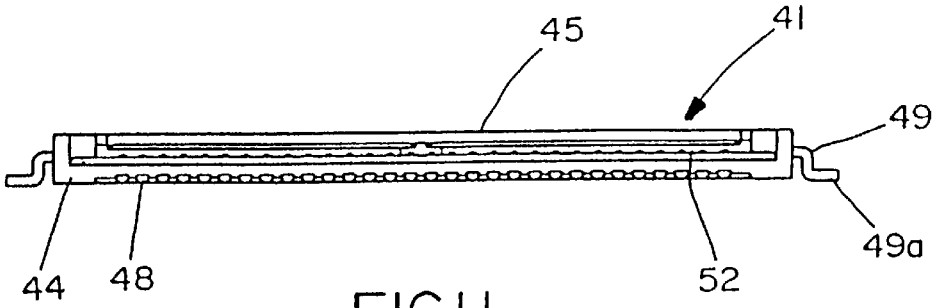
FIG. 11 is a front elevational view of the connector of FIG. 8.
Figure 12:
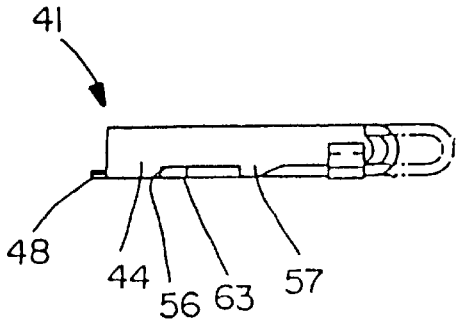
FIG. 12 is an end elevational view of the connector of FIG. 8, with the actuator shown in phantom in its preliminary position.
Figure 19:
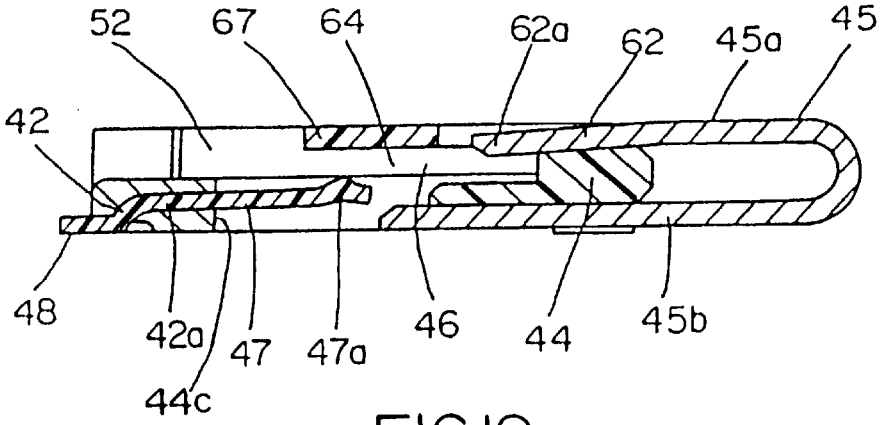
FIG. 19 is a view similar to that of FIG. 9, with the actuator in its first position and the flat circuit removed.

More particularly, as best seen in FIGS. 9 and 19, each terminal 42 has an intermediate section 42*a* overmolded by housing 44, leaving a contact portion 47 and a solder tail portion 48 exposed outside the housing. The contact portion is cantilevered into an opening 44*c* in housing 44, with a contact projection 47*a* at a distal end of the contact portion projecting into slot 46.

Figure 13:
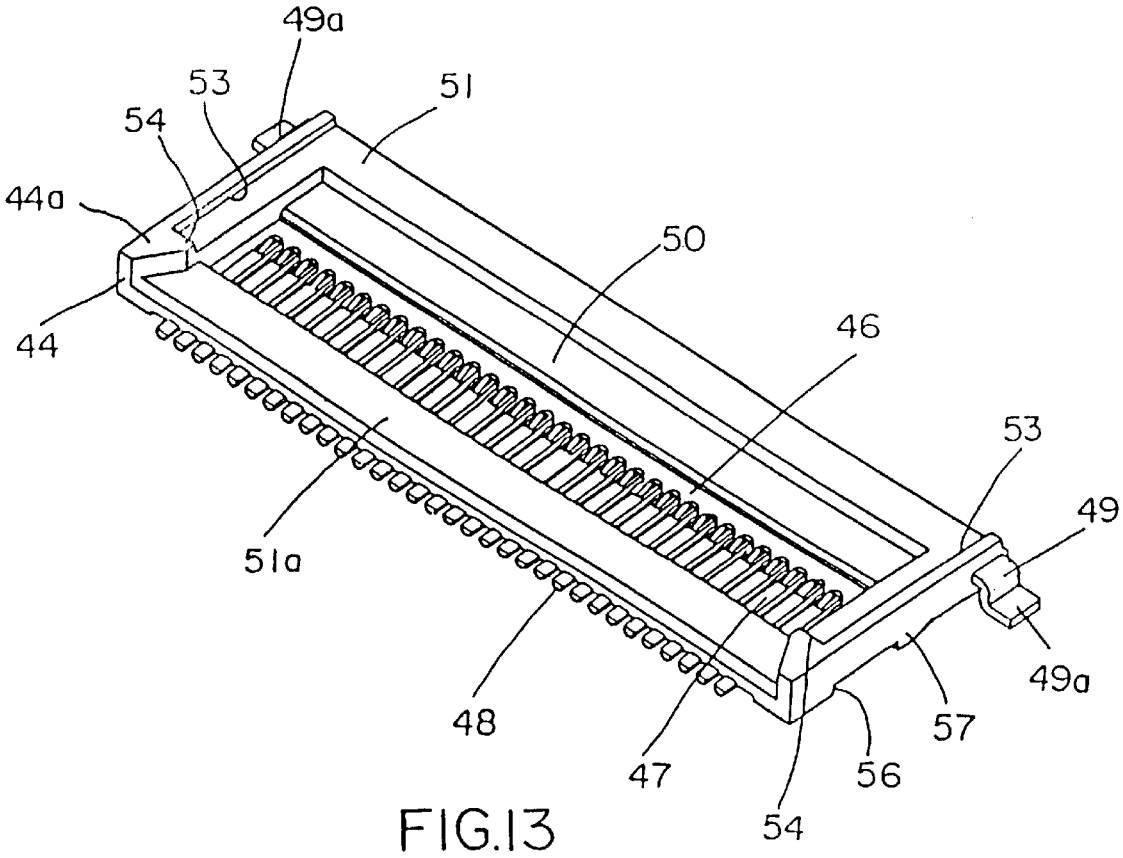
FIG. 13 is a top perspective view of the connector of FIG. 8, with the actuator removed.

As best seen in the top perspective view of FIG. 13, housing 44 has a lateral shelf 50 adjacent the free ends of contact portions 47 of the terminals. The housing has a flat U-shaped stepped surface 51 recessed from a top surface 44*a* of the housing equal to the thickness of a top plate 45A of actuator 45 so that the top of the actuator is substantially flush with top surface 44*a* of the housing. A flat surface 51*a* defines the bottom of a mouth 52 (FIG. 9) for receiving flat circuit 43 inserted into slot 46. Surface 51*a* is substantially at the same level as shelf 50. Guide walls 53 are formed at opposite ends of stepped surface 51, and stop walls 54 are formed at opposite ends of the circuit-receiving mouth.

Figure 14:
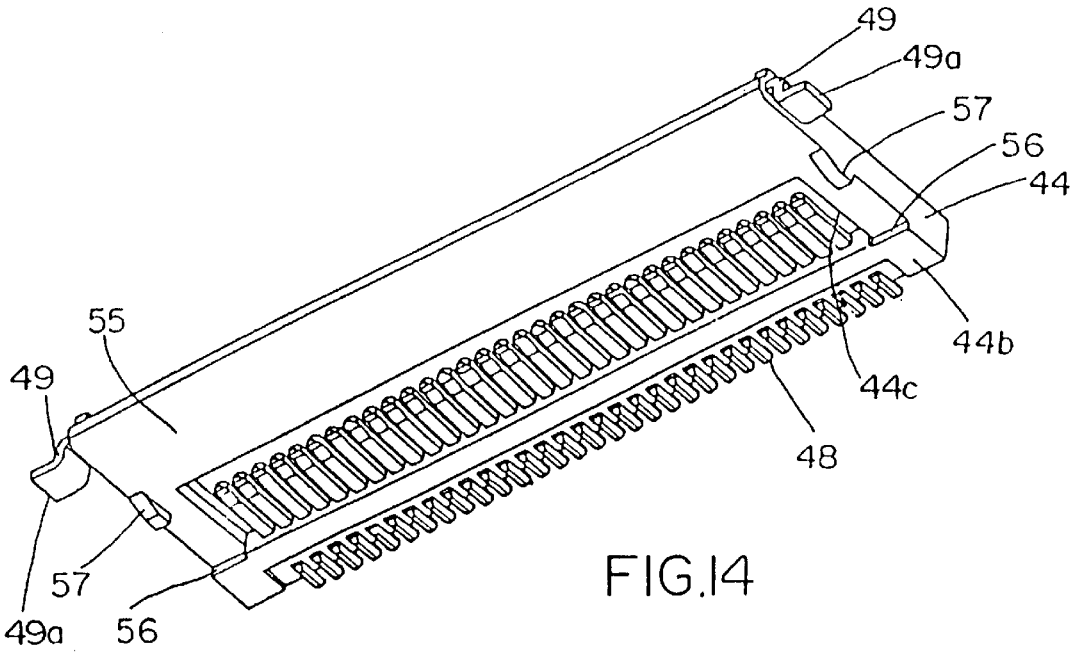
FIG. 14 is a bottom perspective view of the connector of FIG. 8, with the actuator removed.
Figure 15:
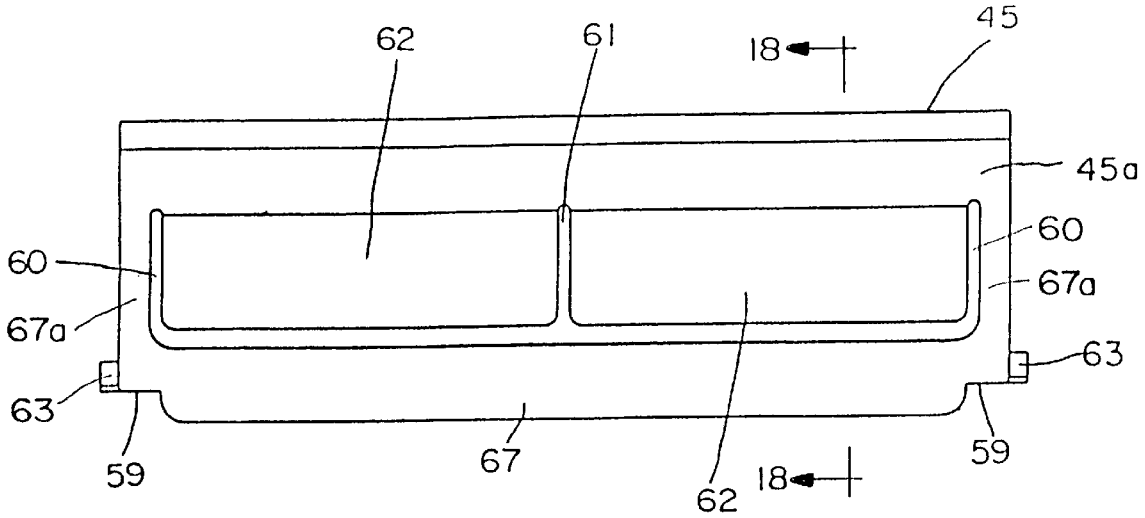
FIG. 15 is a top plan view of the actuator of the connector of FIG. 8.
Figure 16:
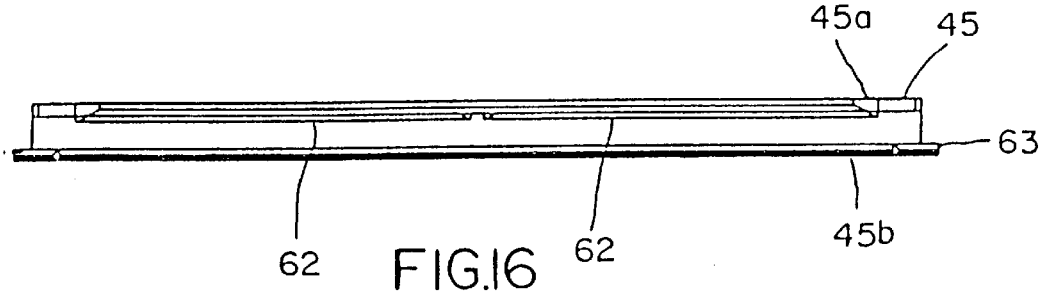
FIG. 16 is a front elevational view of the actuator.

Referring to the bottom perspective view of FIG. 14, housing 14 further has a flattened, U-shaped stepped surface 55 recessed inwardly of a bottom surface 44*b* of the housing. Stepped surface 55 is recessed from bottom surface 44*b* a distance substantially equal to the thickness of a bottom plate 45*b* of actuator 45 so that the bottom surface of the actuator is substantially flush with the bottom surface of the housing. Stop walls 56 and inclined latch projections 57 also are formed on the bottom of the housing.

As seen in both FIGS. 13 and 14, a pair of fixing members 49 are insert molded in opposite ends of housing 44 and include exposed tab portions 49*a* for solder connection to appropriate mounting pads on a printed circuit board.

Referring to FIGS. 15–18, actuator 45 is stamped and formed of sheet metal material, such as aluminum or the like. At least the areas of the actuator which engage contact portions 47 of terminals 42 are coated with a dielectric material 58 (FIG. 9), such as an insulating resin. For simplicity purposes, the entire sheet metal material of the actuator can be coated with the insulating material.

Figure 17:
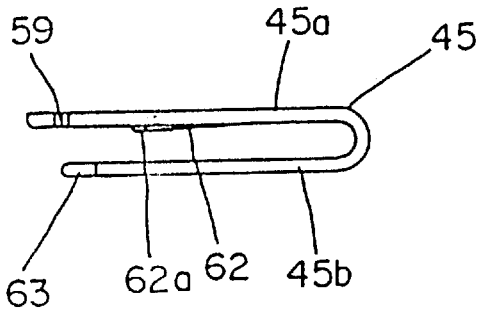
FIG. 17 is an end elevational view of the actuator.
Figure 18:
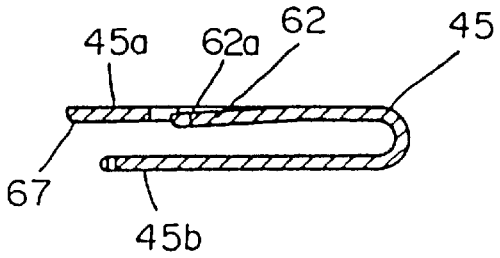
FIG. 18 is a vertical section taken generally along line 18—18 of FIG. 15.

Actuator 45 is formed in a generally U-shaped configuration to define top plate 45*a* and bottom plate 45*b*. The top plate has notched corners 59 at the front thereof to abut stop walls 54 (FIG. 13) on the top of housing 44. A preliminary holding strip 67, similar to preliminary holding strip 22 of the first embodiment, extends between notched corners 59. The preliminary holding strip is disposed above surface 51*a* (FIG. 13) to define a mouth therebetween for receiving the flat circuit. The preliminary holding strip forms a cross portion between a pair of legs 67*a* of a U-shaped section of the metal actuator. The rear ends of legs 67*a* are joined to a rear area of top plate 45*a* of the actuator. A pair of pressure-applying fingers 62, separated by a slot 61, project forwardly into the U-shaped section and are separated from legs 67*a* by open areas 60. Therefore, like the first embodiment, the flexibility of preliminary holding strip 67 is independent of or isolated from the flexibility of fingers 62. As best seen in FIG. 17, the free ends 62*a* of fingers 62 are inclined downwardly or inwardly.

Bottom plate 45*b* of actuator 45 is generally flat and has rectangular projections 63 at the front corners thereof. These projections are captured between stop walls 56 (FIG. 14) and inclined latch projections 57 of the housing when the actuator is mounted on the housing. This can be seen best in FIG. 12 and allows for movement of the actuator between its inoperative and operative positions.

Figure 8:
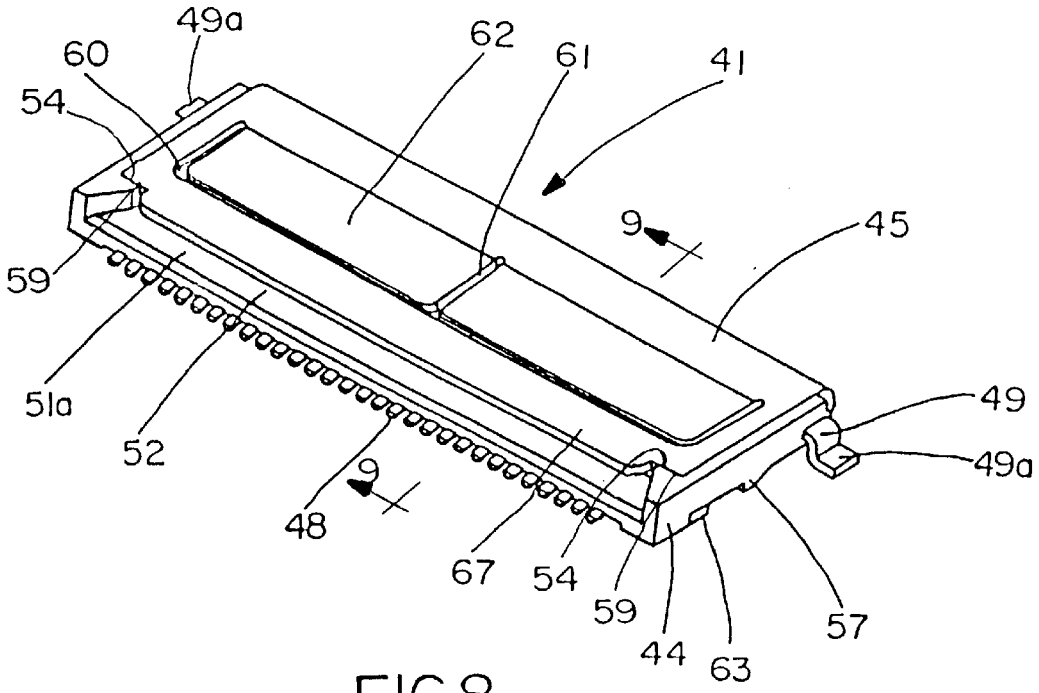
FIG. 8 is a perspective view of a connector for a flat circuit according to a second embodiment.

In operation of the second embodiment, U-shaped actuator 45 is mounted about the rear of housing 44 as best seen in FIG. 19, with the actuator in a first position as shown therein. In this position, flat circuit 43 can be inserted freely into slot 64 of the housing. The actuator then is moved forwardly in the direction of arrow "B" (FIG. 9) to a second position whereat fingers 62 bias a free end 43*a* of flat circuit 43 against contact projections 47*a* of contact portions 47 of terminals 42. At the same time, bottom plate 45*b* of the actuator abuts against the bottoms of contact portions 47 of the terminals, as at 70. With the actuator coated with insulating material, the bottom plate does not short the terminals. Therefore, it can be seen that actuator 45 performs dual functions of (1) biasing flat circuit 43 against the contact portions of the terminals and (2) also providing reinforcing support for the contact portions. In addition, preliminary holding strip 67 provides a means for temporarily holding the flat circuit while an operator manually manipulates the actuator. When the actuator is in its final or second position, notched corners 59 (FIG. 15) of the actuator engage stop walls 54 (FIG. 13) of the housing, as seen in FIG. 8.

By fixing contact portions 6 of terminals 7 in the first embodiment, and by reinforcing contact portions 47 of terminals 42 in the second embodiment, the overall profile of the connectors can be made thinner because the flexibility required to maintain a positive contact between the flat circuit and the terminals is provided by the pressure plate portions or fingers of the actuators.

Figure 20:
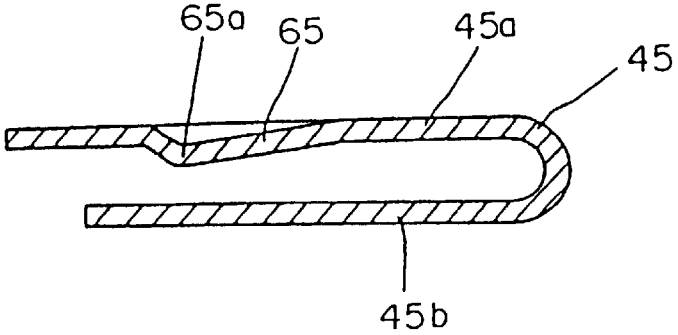
FIG. 20 is a view similar to that of FIG. 18, but of an alternate embodiment of the actuator.

Lastly, FIG. 20 shows an alternate embodiment of an actuator 45 which does not include a separated preliminary holding strip. In this embodiment, bulged areas 65 have downwardly formed projections 65*a* which oppose contact projections 47*a* of contact portions 47 of terminals 42 when the actuator is moved to its connecting or terminating position. Projections 65*a* of the actuator bias the flat circuit against projections 47*a* of the terminals. Nevertheless, this actuator also performs the dual functions of biasing the circuit against the contact portions of the terminals and also providing reinforcing support for the contact portions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for mounting on a surface of a printed circuit board and for receiving a flat electrical circuit, comprising:

an elongated dielectric housing defining a slot for receiving the flat electrical circuit;

a plurality of terminals mounted on the housing with contact portions spaced along the slot;

a metal fixing member mounted on the housing for securing the connector to an appropriate mounting pad on the printed circuit board, a portion of the metal fixing member passing through the housing;

a metal actuator mounted on the housing for movement between a first position allowing free insertion of the flat electrical circuit into the slot and a second position biasing the flat electrical circuit against the contact portions of the terminals; and complementary interengaging metal to metal positioning means between the portion of the metal fixing member passing through the housing and the metal actuator to at least partially define at least one of said positions of the actuator.

2. The electrical connector of claim 1, including one of said fixing members and said complementary interengaging positioning means at each opposite end of the elongated dielectric housing.

3. An electrical connector for mounting on a printed circuit board and for receiving a flat electrical circuit, comprising:

a dielectric housing defining a slot for receiving the flat electrical circuit;

a plurality of terminals mounted on the housing with contact portions spaced along the slot;

a fixing member on the housing for securing the connector to the printed circuit board, a portion of the fixing member passing through the housing;

an actuator mounted on the housing for movement between a first position allowing insertion of the flat electrical circuit into the slot and a second position biasing the flat electrical circuit against the contact portions of the terminals; and complementary interengaging metal to metal positioning means between the portion of the fixing member passing through the housing and the actuator to at least partially define at least one of said positions of the actuator.

4. The electrical connector of claim 3, including one of said fixing members and said complementary interengaging positioning means at each opposite end of the dielectric housing.

5. An electrical connector for mounting on a surface of a printed circuit board and for receiving a flat electrical circuit, comprising:

an elongated dielectric housing defining a slot for receiving the flat electrical circuit;

a plurality of terminals mounted on the housing with contact portions spaced along the slot;

a metal fixing member mounted on the housing for securing the connector to an appropriate mounting pad on the printed circuit board;

a metal actuator mounted on the housing for movement between a first position allowing free insertion of the flat electrical circuit into the slot and a second position biasing the flat electrical circuit against the contact portions of the terminals;

complementary interengaging positioning means between the metal fixing member and the metal actuator including a flexible latch arm on the metal actuator which seats behind a pair of stop shoulders on the metal fixing member to respectively define the two positions of the actuator.

6. An electrical connector for mounting on a printed circuit board and for receiving a flat electrical circuit, comprising:

a dielectric housing defining a slot for receiving the flat electrical circuit;

a plurality of terminals mounted on the housing with contact portions spaced along the slot;

a fixing member on the housing for securing the connector to the printed circuit board;

an actuator mounted on the housing for movement between a first position allowing insertion of the flat electrical circuit into the slot and a second position biasing the flat electrical circuit against the contact portions of the terminals; and complementary interengaging positioning means between the fixing member and the actuator including a flexible latch arm on the actuator which seats behind a pair of stop shoulders on the fixing member to respectively define the two positions of the actuator.

* * * * *